United States Patent [19]

Kessler et al.

[11] Patent Number: 4,571,904

[45] Date of Patent: Feb. 25, 1986

[54] PATIENT ENCLOSURE

[75] Inventors: Laibe A. Kessler; Jean M. Walsh, both of Pittsburgh, Pa.

[73] Assignee: Allegheny-Singer Research Corporation, Pittsburgh, Pa.

[21] Appl. No.: 539,580

[22] Filed: Oct. 6, 1983

[51] Int. Cl.[4] ..... E04H 3/08

[52] U.S. Cl. ..... 52/205; 5/83 R; 52/166; 52/239

[58] Field of Search ..... 5/93 R, 99 C, 99 B, 5/1, 10 R, 100; 52/106, 36, 205

[56] References Cited

U.S. PATENT DOCUMENTS

| | | | |
|---|---|---|---|
| 1,079,675 | 11/1913 | Trimble | 5/99 C |
| 1,340,694 | 5/1920 | Wingett | 5/99 C |
| 2,059,240 | 11/1936 | Johnston | 5/100 |
| 2,323,455 | 7/1943 | Creech | 52/106 |
| 2,632,186 | 3/1953 | Berk | 5/99 B |
| 3,194,361 | 7/1965 | Thurman | 52/239 |
| 3,195,698 | 7/1965 | Codrea | 52/239 |
| 3,235,890 | 2/1966 | Zalicovitz | 5/99 R |
| 3,321,779 | 5/1967 | Kaufman | 5/93 R |
| 3,498,587 | 3/1970 | Friedberg | 5/99 C |
| 3,703,734 | 11/1972 | Carr | 5/99 R |
| 3,733,759 | 5/1973 | Schulte | 52/239 |
| 3,763,506 | 10/1973 | Szego | 5/99 R |
| 3,777,321 | 12/1973 | Hargett | 5/99 C |
| 3,924,280 | 12/1975 | Vaiano | 5/99 R |
| 4,402,097 | 9/1983 | Scott | 5/99 A |

*Primary Examiner*—John E. Wurtagh

*Attorney, Agent, or Firm*—Webb, Burden, Robinson & Webb

[57] ABSTRACT

A patient enclosure treatment center includes an outer room and an inner enclosure. The outer room is formed of a floor, a plurality of walls and a ceiling and is environmentally pleasant. The inner enclosure, positioned on the outer room floor, is free of furniture. The top of the inner enclosure is open to the environment of the outer room and is formed of a barrier and a padded floor within the periphery of said inner enclosure. The barrier extends vertically from the floor about the periphery of the inner enclosure, is padded on its interior surface, and is of sufficient height to protect a patient. The barrier further includes means for entering and exiting the inner enclosure and means for viewing the interior of said enclosure. The padded floor lies on top of the outer room floor and contacts the lower portion of the barrier. The inner enclosure must be of a size sufficient to allow a patient to move freely within the inner enclosure.

7 Claims, 2 Drawing Figures

PATIENT ENCLOSURE

BACKGROUND OF THE INVENTION

The invention relates to a patient enclosure, and more particularly, to an enclosure for patients suffering from severe brain damage or the like.

Severely brain damaged patients, such as those involved in automobile accidents or tumor operations, are in many ways like children. The can easily fall out of bed and can easily injure themselves, either accidentally or deliberately, by banging their heads against a hard object such as a wall or railing.

In many cases, such patients are treated by strapping them to a standard hospital bed with full body restraints that completely limit their movement to prevent any further injury. Such patients are usually heavily sedated. Because the brain damaged patient must learn to crawl, stand and walk again, such restraints prohibit the natural recovery process.

A further method for treating such patients is to place them in a padded room from which all of the furniture is removed. The floor and walls are padded, often with mattresses, to cover anything that might injure the patient as the patient moves around the room. However, such rooms have a sterile atmosphere and are depressing and uncomfortable for visitors. Further, such rooms are difficult to maintain because such patients often lack control of their body functions and sheets must be frequently changed and the entire area sanitized.

Accordingly, it is desired to develop an enclosure that will allow such a patient to move around while protecting him from injury, is easily maintained, and has a pleasant environment in order to allow the patient to recover in the most comfortable, familiar surroundings possible and to make the area more accommodating for family and other vistors. In addition, it is desired to provide an environment which will actually enhance and quicken the rate of recovery of the patient. Further, the enclosure should be easily assembled and easily taken apart.

BRIEF DESCRIPTION OF THE INVENTION

A patient enclosure treatment center is provided that includes an outer room and an inner enclosure. The outer room is formed of a floor, a plurality of walls and a ceiling, and is environmentally pleasant. The inner enclosure, positioned on the outer room floor, is free of furniture. The top of the inner enclosure is open to the environment of the outer room. The inner enclosure is formed of a barrier and a padded floor within the periphery of said barrier. The barrier extends vertically from the floor about the periphery of the inner enclosure, is padded on its interior surface, and is of sufficient height to protect a patient. The barrier further includes means for entering and exiting the inner enclosure and means for viewing the interior of said enclosure. The padded floor lies on top of the outer room floor and contacts the lower portion of the barrier. The inner enclosure must be of a size sufficient to allow a patient to move freely within the inner enclosure yet must generally allow freedom of movement between the inner enclosure and outer room.

The barrier may be formed of a frame including a plurality of spaced vertical members retained in an assembled position by upper and lower horizontally disposed support members. The frame, which may include a then sheet material such as aluminum or steel sheeting, is padded on its interior surface and covered with a soft, easily maintained material. The height of the barrier is approximately the shoulder height of the patient. The barrier may be adapted to allow for access to a power supply, IV cords, oxygen equipment and other medical equipment within the inner enclosure.

The barrier may also include a door to allow hospital staff and visitors to gain acces to the inner enclosure. The door is preferably wide enough to allow hospital equipment such as a gurney or cardiac arrest equipment to be brought into the enclosure. Further, the height of the door is preferably lower than the height of the rest of the barrier to enable the hospital staff and visitors to view the interior of the inner enclosure.

The padded floor of the inner enclosure may be formed of mattresses covered with soft, easily maintained material. The floor is preferably square and occupies an area of approximately 64 sq. ft.

The outer room may be a hospital room. In addition, the enclosure is easily assembled and disassembled so that it may be used in a room in the patient's home.

DETAILED DESCRIPTION OF THE PREFERRED EMBODIMENT

Figure 1:
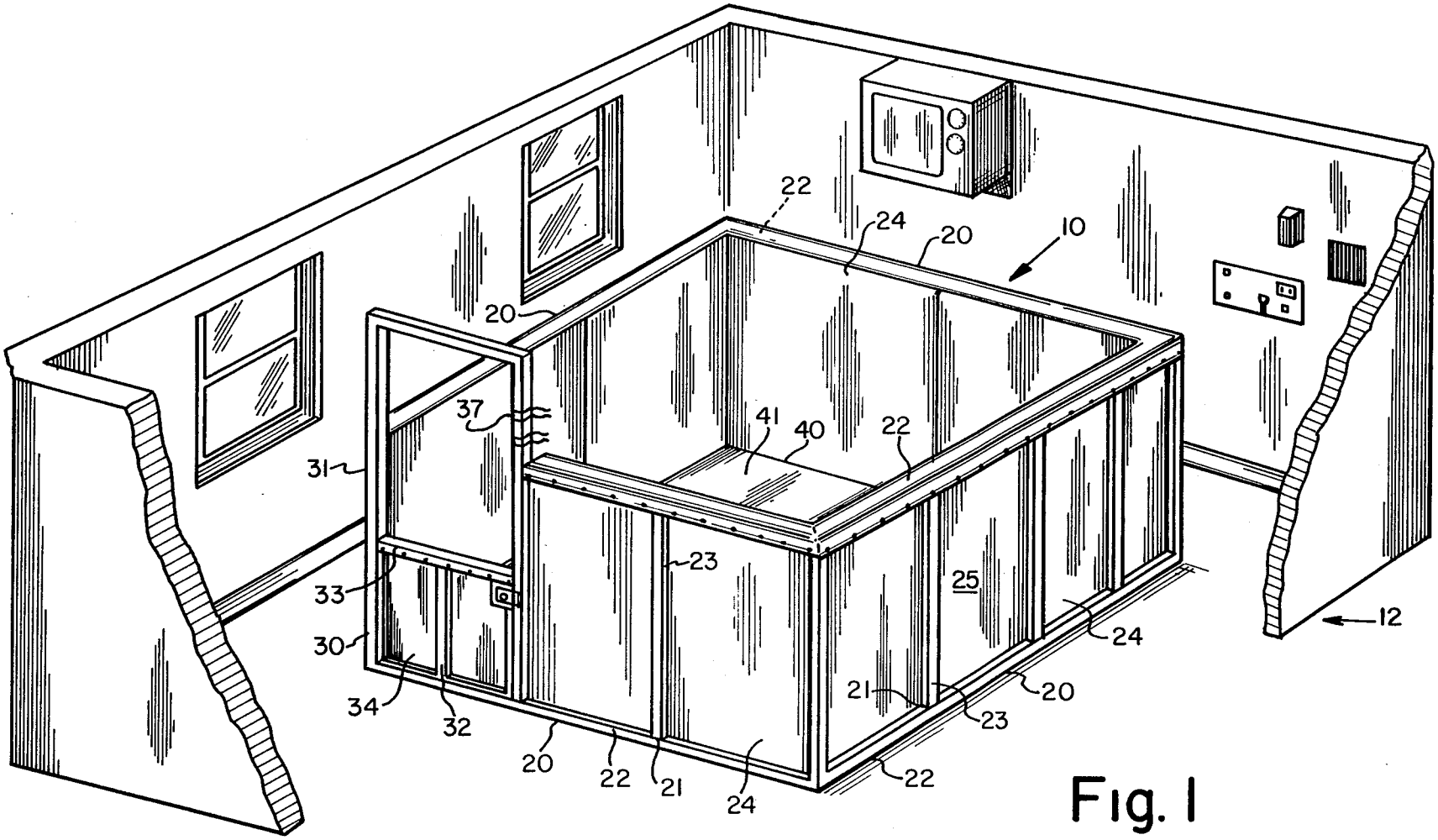
FIG. 1 is a perspective view of the patient enclosure according to the teachings of the present invention in a hospital room.
Figure 2:
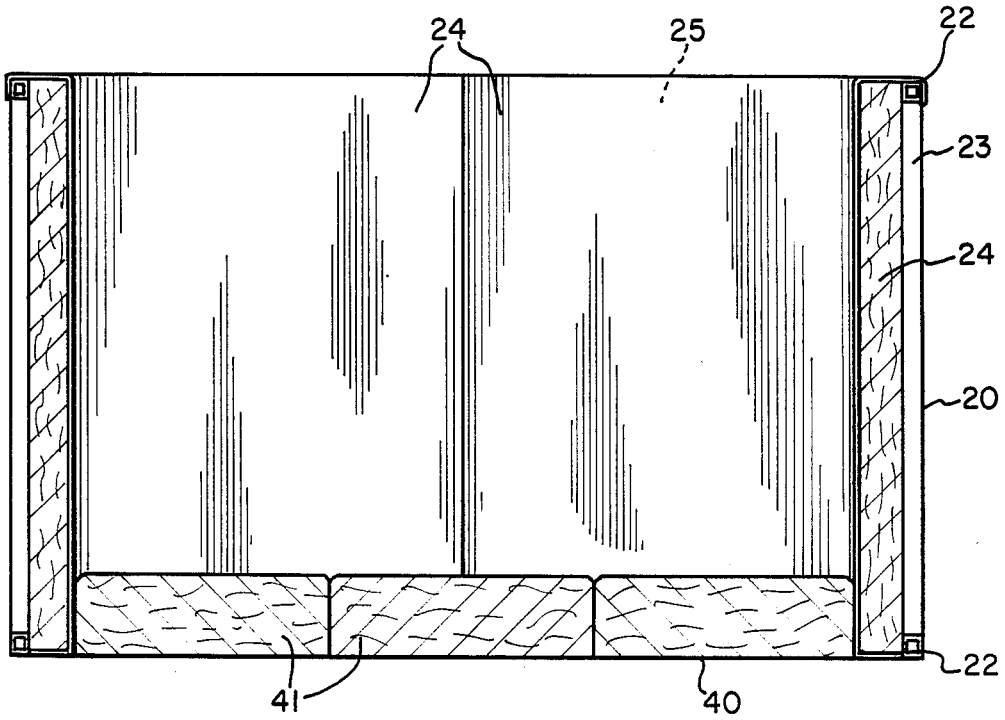
FIG. 2 is a perspective view through line II—II of FIG. 1 showing the wall panels of the enclosure.

An exemplary patient enclosure 10 according to the present invention is illustrated in FIG. 1. Patient enclosure 10 of FIG. 1 is shown in the environment of a typical hospital room 12. Patient enclosure 10 includes barrier 20, door 30 and floor 40.

Barrier 20 of patient enclosure 10 includes frame 21 formed of upper and lower horizontal supports 22, a plurality of vertical supports 23 and a thin sheet metal wall 25. Supports 22 and 23 may be formed of any suitable material, such as lightweight aluminum tubing. Frame 21 supports padding 24 on its interior surface. Padding 24 may be covered by a soft, easily maintained material such as that sold under the mark Naugahyde ®. The padding may also take the form of individual panel members having a stiff inner side, thereby negating the need for the thin wall 25. Although not shown in the Figure, barrier 20 may include openings for access to emergency equipment such as a power supply, IV cords and oxygen which the patient may need. Barrier 20 includes a door 30 to allow for access to the inside of the enclosure 10. Door 30 is mounted within door frame 31. Frame 31 includes vertical and horizontal supports 32 and 33, respectively, at its lower portion so that the lower portion of frame 31 may be padded and covered with a soft, easily maintained material such as Naugahyde ® material. Door 30 only occupies the lower portion of frame 31. Brackets 37 extend from the upper portion of frame 31 to accommodate care or treatment equipment (not shown). Frame 31 actually is of a greater height than the barrier 20 for ease of entry.

Floor 40 lies within patient enclosure 10 on top of the floor of the surrounding room 12 and contacts the lower portion of barrier 20. Floor 40 is padded. The padding may be formed of a plurality of mattresses 41, a combination of mattresses and padded fillers or a single large pad. One or more mattresses are desirable since they must perform as the patient's bed. It is alos desirable to have a firmer filler pad since, as the patient recovers and begins to try to walk, it is easier to walk on a firm pad rather than a mattress. Furthermore, a filler pad can be removed for walking on a solid floor under supervision when possible.

Enclosure 10 must included enough floor space so that a patient has sufficient room to move around without unduly confining the patient. For example, a floor area of approximately 8′ by 8′ (64 square feet) is large enough for such purpose. Enclosure 10 is sufficiently high to protect the patient but low enough to allow the patient to perceive his surrounding, such as natural light, television and music. Preferably, barrier 20 is approximately 5′ high. The walls are constructed so that they can accommodate pictures and other decorations to make the environment more familiar and pleasant for a patient.

The padded portion of door 30 is low enough so that a patient inside enclosure 10 may be easily viewed from outside enclosure 10, and wide enough so that hospital equipment such as a gurney or cardiac arrest equipment can be easily brought into the enclosure. Preferably, the padded portion of door 30 is approximately 4′ wide by 2½′ high.

As shown in FIG. 1, enclosure 10 may be placed in a standard hospital room that is cleared of excess furniture and equipment. However, because patient enclosure 10 is light and can be assembled, disassembled and stored easily, it may be set up in the patient's home. This would allow the patient to recover in familiar surroundings without requiring constant supervision.

The patient enclosure has been described for use with brain damaged patient. However, it is also useful with other patients who have impaired judgment due to illness, accident or age. The patient enclosure permits some mobility for the patient but a controlled and protected mobility.

It has been found that the patient enclosure stimulates recovery of patients. It gives the patient more self-dignity and freedom that possible previously. It is interesting to note that the lack of restrain in the patient enclosure has appeared to eliminate the desire or tendency of brain damaged patients to try to remove intravenous feeding and medication equipment.

We claim:

1. A patient enclosure treatment center comprising:

A. an outer room formed of a floor, a plurality of walls and a ceiling, said outer room being environmentally pleasant; and B. an inner enclosure positioned on said floor, free of furniture, sides of which are visually closed and a top of which is open to the environment of said outer room and formed from:

i. a barrier extending vertically from the floor about the periphery of said inner enclosure to a height about the shoulder height of the patient, said barrier formed of a frame including a plurality of spaced vertical members retained in an assembled position by upper and lower horizontally disposed support members, a door frame and a door disposed in the lower portion of said door frame for entering and exiting said inner enclosure, said door being lower than said barrier frame so as to permit viewing the interior of said enclosure, and said door frame extending vertically above the barrier frame, said barrier padded on its interior surface and covered with a soft, easily maintained material, and ii. a padded floor within the periphery of said inner enclosure lying on top of said floor and contacts the lower portion of barrier, said inner enclosure being of a size sufficient to allow a patient to move freely within said inner enclosure.

2. A patient enclosure as recited in claim 1 wherein said barrier is adapted to allow for access to a power supply, IV cords and oxygen equipment from within said inner enclosure.

3. A patient enclosure as recited in claim 1 wherein said padded floor is formed of a plurality of mattresses.

4. A patient enclosure as recited in claim 1 wherein said floor is preferably square and occupies an area of approximately 64 sq. ft.

5. A patient enclosure as recited in claim 1 wherein said outer room is a hospital room.

6. A patient enclosure as recited in claim 1 wherein said outer room is a room in the patient's home.

7. A patient enclosure as recited in claim 1 wherein said enclosure is easily assembled, disassembled and stored.

* * * * *

UNITED STATES PATENT AND TRADEMARK OFFICE

CERTIFICATE OF CORRECTION

PATENT NO. : 4,571,904

DATED : February 25, 1986

INVENTOR(S) : Laibe A. Kessler, et al.

It is certified that error appears in the above-identified patent and that said Letters Patent is hereby corrected as shown below:

Column 1 Line 10 "The" should read —They—.

Column 1 Line 68 "then" should read —thin—.

Column 2 Line 8 "acces" should read -access—.

Column 2 Lines 34 & 35 "encl-oure" should read —enclosure—.

Column 2 Line 49 "Figure" should read —Figures—.

Column 3 Line 1 "alos" should read —also—.

Column 3 Line 7 "included" should read —include—.

Column 3 Line 11 "purpose" should read —purposes—.

UNITED STATES PATENT AND TRADEMARK OFFICE

CERTIFICATE OF CORRECTION

PATENT NO. : 4,571,904

DATED : February 25, 1986

INVENTOR(S) : Laibe A. Kessler, et al.

It is certified that error appears in the above-identified patent and that said Letters Patent is hereby corrected as shown below:

Column 3 Line 13 "surrounding" should read —surroundings—.

Column 3 Line 35 "patient" should read —patients—.

Column 3 Line 42 "that" should read —than—.

Column 3 Line 43 "restrain" should read —restraint—.

Signed and Sealed this

*Twenty-fourth* Day of *June 1986*

[SEAL]

*Attest:*

DONALD J. QUIGG

*Attesting Officer*

*Commissioner of Patents and Trademarks*